US011479899B2

(12) United States Patent
Kim et al.

(10) Patent No.: US 11,479,899 B2
(45) Date of Patent: Oct. 25, 2022

(54) WASHING MACHINE

(71) Applicant: SAMSUNG ELECTRONICS CO., LTD., Suwon-si (KR)

(72) Inventors: Zoo Hyeong Kim, Suwon-si (KR); Jae Young Kim, Suwon-si (KR); Min Jea Choi, Suwon-si (KR); Ji Woong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/251,277

(22) PCT Filed: Mar. 14, 2019

(86) PCT No.: PCT/KR2019/002992
§ 371 (c)(1),
(2) Date: Dec. 11, 2020

(87) PCT Pub. No.: WO2019/245132
PCT Pub. Date: Dec. 26, 2019

(65) Prior Publication Data

US 2021/0262142 A1 Aug. 26, 2021

(30) Foreign Application Priority Data

Jun. 19, 2018 (KR) ..... 10-2018-0070038

(51) Int. Cl.
*D06F 37/22* (2006.01)
*D06F 17/10* (2006.01)
(Continued)

(52) U.S. Cl.
CPC ..... *D06F 37/42* (2013.01); *D06F 17/10* (2013.01); *D06F 37/22* (2013.01); *D06F 37/40* (2013.01); *D06F 39/12* (2013.01); *D06F 39/14* (2013.01)

(58) Field of Classification Search
CPC ..... D06F 17/10; D06F 37/40; D06F 39/10; D06F 17/06; D06F 37/22; D06F 37/42;
(Continued)

(56) References Cited

U.S. PATENT DOCUMENTS 2,821,848 A * 2/1958 Becker ..... D06F 13/00 68/17 A
5,421,174 A * 6/1995 Kim ..... D06F 13/02 68/17 R
(Continued)

FOREIGN PATENT DOCUMENTS

CN 105369524 A 3/2016
CN 207031786 U 2/2018
(Continued)

OTHER PUBLICATIONS

Murase, Koji; "Washing/Drying Machine", Dec. 1991, JP03-280992—Machine Translation (Year: 1991).*
(Continued)

*Primary Examiner* — Michael E Barr
*Assistant Examiner* — Thomas Bucci
(74) *Attorney, Agent, or Firm* — Staas & Halsey LLP

(57) ABSTRACT

The present disclosure relates to a washing machine to which a pulsator structure capable of preventing damage to a pulsator is applied.
The washing machine includes a cabinet in which an opening for putting laundry is formed on a front side, a tub provided inside the cabinet, a drum rotatably provided inside the tub, a pulsator rotatably installed on the drum, and a cap coupled to the pulsator to cover at least a portion of a front surface thereof, wherein the cap includes a hole formed to discharge air.

12 Claims, 9 Drawing Sheets

(51) Int. Cl.
*D06F 37/40* (2006.01)
*D06F 37/42* (2006.01)
*D06F 39/12* (2006.01)
*D06F 39/14* (2006.01)

(58) Field of Classification Search
CPC ..... D06F 39/12; D06F 39/14; D06F 17/08; D06F 37/06
USPC ..... 68/53, 134, 17 A
See application file for complete search history.

(56) References Cited

U.S. PATENT DOCUMENTS 5,473,916 A * 12/1995 Ye ..... D06F 17/10 68/134
5,595,072 A * 1/1997 Bai ..... D06F 17/06 68/183
5,596,891 A * 1/1997 Bae ..... D06F 17/06 68/133
5,680,779 A * 10/1997 Na ..... D06F 17/10 68/133
5,680,780 A * 10/1997 Kim ..... D06F 17/10 68/134
5,727,403 A * 3/1998 Na ..... D06F 17/10 68/133
5,765,405 A * 6/1998 Jung ..... D06F 17/08 68/133
5,839,300 A * 11/1998 Yoon ..... D06F 23/04 68/134
5,865,047 A * 2/1999 Yoon ..... D06F 17/10 68/134
5,878,600 A * 3/1999 Yeo ..... D06F 17/06 68/23.5
5,906,118 A * 5/1999 Cho ..... D06F 17/10 68/53
5,941,100 A * 8/1999 Ahn ..... D06F 39/10 68/53
2003/0200774 A1* 10/2003 Kim ..... D06F 17/06 68/132
2004/0163429 A1* 8/2004 Lim ..... D06F 37/40 68/140
2009/0293203 A1* 12/2009 Hettinger ..... D06F 39/024 68/17 A
2013/0319056 A1* 12/2013 Lee ..... D06F 17/10 68/132
2017/0073868 A1* 3/2017 Lv ..... D06F 17/10
2018/0251928 A1* 9/2018 Lee ..... D06F 21/14

FOREIGN PATENT DOCUMENTS

JP 03280992 A * 12/1991
JP 2013-202320 A 10/2013
KR 10-2013-0136748 A 12/2013
KR 10-2016-0130823 A 11/2016

OTHER PUBLICATIONS

Non-Patent Literature, Samsung Electronics Co., Ltd., (pictures 1-4), Feb. 1, 2018, non-official translation (The Pictures Related to the Application of Mass Production).
International Search Report dated Jul. 15, 2019, in corresponding International Patent Application No. PCT/KR2019/002992.

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2019/002992 filed on Mar. 14, 2019, which claims foreign priority benefit under 35 U.S.C. § 119 of Korean Patent Application 10-2018-0070038 filed on Jun. 19, 2018, in the Korean Intellectual Property Office, the contents of both of which are incorporated herein by reference.

TECHNICAL FIELD

The present disclosure relates to washing machine, and more particularly, to a washing machine equipped with a pulsator.

BACKGROUND ART

A washing machine is a machine that uses electric power to wash clothes. In general, a washing machine includes a tub for storing washing water, a drum rotatably installed inside the tub, a pulsator rotatably installed at the bottom of the drum, and a motor for rotating the drum and the pulsator.

When the drum and the pulsator are rotated by the motor in a state in which laundry and water mixed with a detergent are put into the inside of the drum, the pulsator cleans the laundry by agitating the laundry put into the drum with washing water to remove dirt from the laundry.

When dehydrating the laundry, the pulsator is stopped or rotates at a low speed and the drum rotates at a high speed to perform dehydration of the laundry. At this time, when the drum rotates at a high speed, the laundry rotates at the same speed as the drum. However, because the pulsator is stopped or rotates at a low speed, friction occurs due to a difference in rotation speed between the laundry and the pulsator.

Damage to the laundry and the pulsator may occur due to the friction between the laundry and the pulsator.

DISCLOSURE

Technical Problem

The present disclosure is directed to providing a washing machine to which a pulsator structure capable of preventing damage to a pulsator and laundry is applied.

The present disclosure is directed to providing a washing machine to which a pulsator structure capable of preventing frictional heat generated by friction between a pulsator and laundry is applied.

The present disclosure is directed to providing a washing machine capable of improving durability by applying different materials to a cap and a cover of a pulsator.

Technical Solution

One aspect of the present disclosure provides a washing machine including a cabinet in which an opening for putting laundry is formed on a front side, a tub provided inside the cabinet, a drum rotatably provided inside the tub, a pulsator rotatably installed on the drum, and a cap coupled to the pulsator to cover at least a portion of a front surface of the plusator, wherein the cap includes a hole formed to discharge air.

A plurality of the holes may be provided.

The cap may include a first cap and a second cap provided to cover a front side of the first cap.

The first cap and the second cap may be formed of different materials.

The second cap may include a metal material.

The plurality of holes may be formed on the first cap and the second cap, respectively.

At least a portion of the plurality of holes of the second cap may be connected to the plurality of holes of the first cap.

Air may flow through the plurality of holes by the rotation of the pulsator or the drum.

The second cap may include a cap blade protruding forward.

The washing machine may further include a driving device configured to independently rotate the pulsator and the drum.

The driving device may include a first shaft configured to rotate the pulsator and a second shaft configured to rotate the drum.

The pulsator may include a pulsator body on which a through hole to which the first shaft is connected is formed, and a pulsator cover configured to cover a front surface of the pulsator body and including a cap installation portion corresponding to the through hole, and the cap may be installed in the cap installation portion.

The pulsator body and the pulsator cover may be formed of different materials, and the pulsator cover may include a metal material.

The pulsator body may include a plurality of air holes.

Another aspect of the present disclosure provides a washing machine including a tub, a drum rotatably installed in the tub to accommodate laundry, a pulsator rotatably installed in the drum, a first shaft configured to rotate the pulsator, a second shaft configured to rotate the drum, and a cap configured to cover at least a portion of a front surface of the plusator, wherein the cap includes a first cap coupled to the pulsator and a second cap formed of a metal material to cover a front side of the first cap.

The cap may include a plurality of holes.

The plurality of holes may be formed on the first cap and the second cap, respectively.

The pulsator may include a pulsator body on which a through hole to which the first shaft is connected is formed, and a pulsator cover configured to cover a front surface of the pulsator body and including a cap installation portion corresponding to the through hole, and the cap may be installed in the cap installation portion.

The pulsator body and the pulsator cover may be formed of different materials, and the pulsator cover may include a metal material.

The pulsator body may include a plurality of air holes.

Advantageous Effects

According to an embodiment of the present disclosure, damage to laundry and a pulsator can be prevented by an improved pulsator structure.

Further, generation of frictional heat due to friction between laundry and the pulsator can be prevented, thereby improving durability.

Further, quality and assembly ability can be improved by applying a cap and a cover having different materials.

MODE OF THE DISCLOSURE

Figure 1:
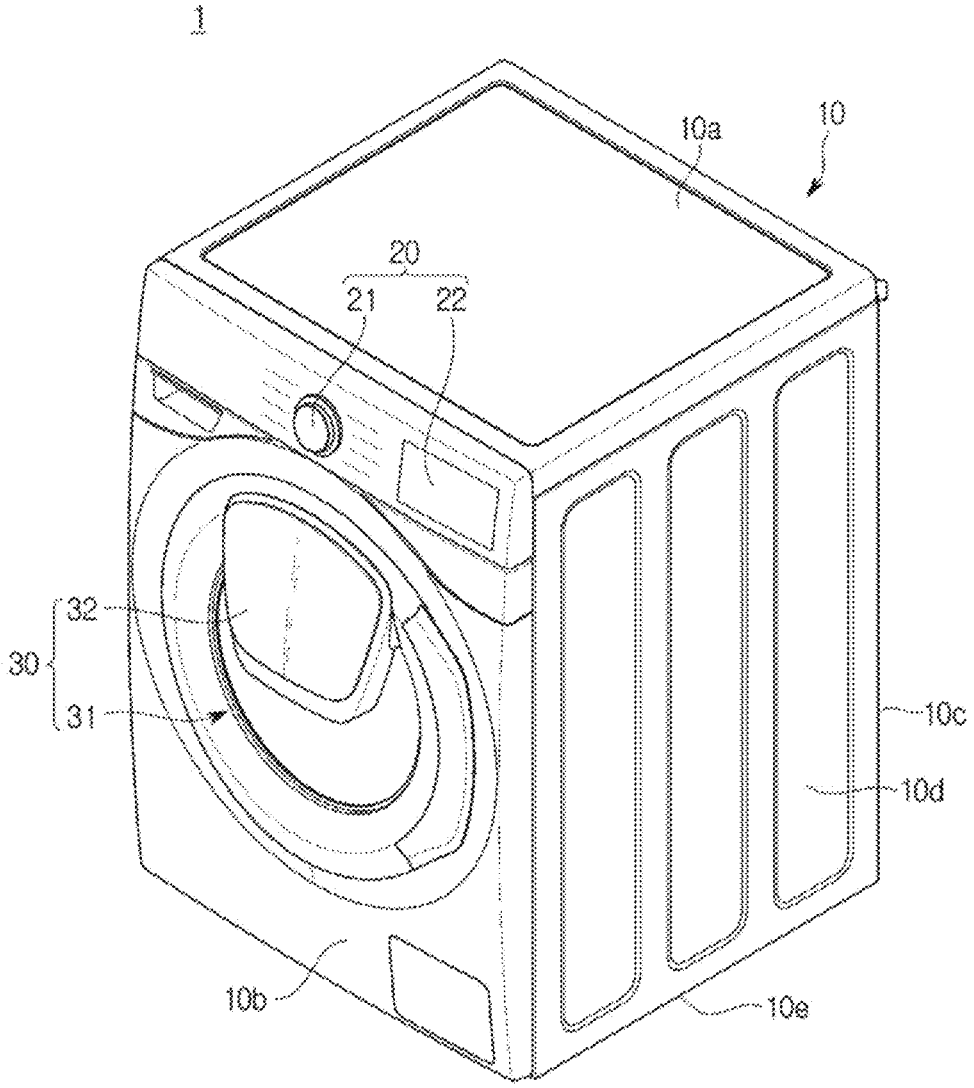
FIG. 1 is a perspective view of a washing machine according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
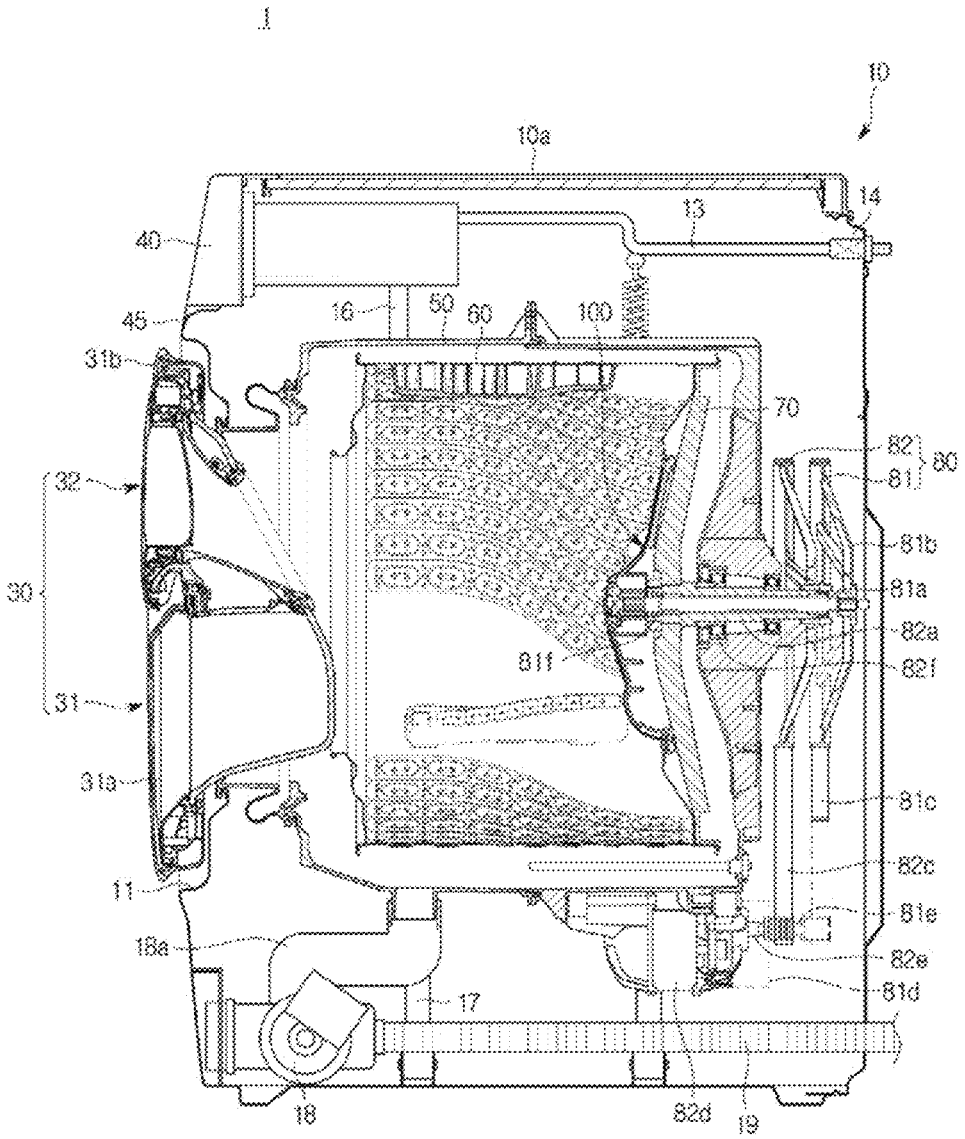
FIG. 2 is a cross-sectional view of the washing machine provided with a pulsator according to an embodiment of the present disclosure.
Figure 3:
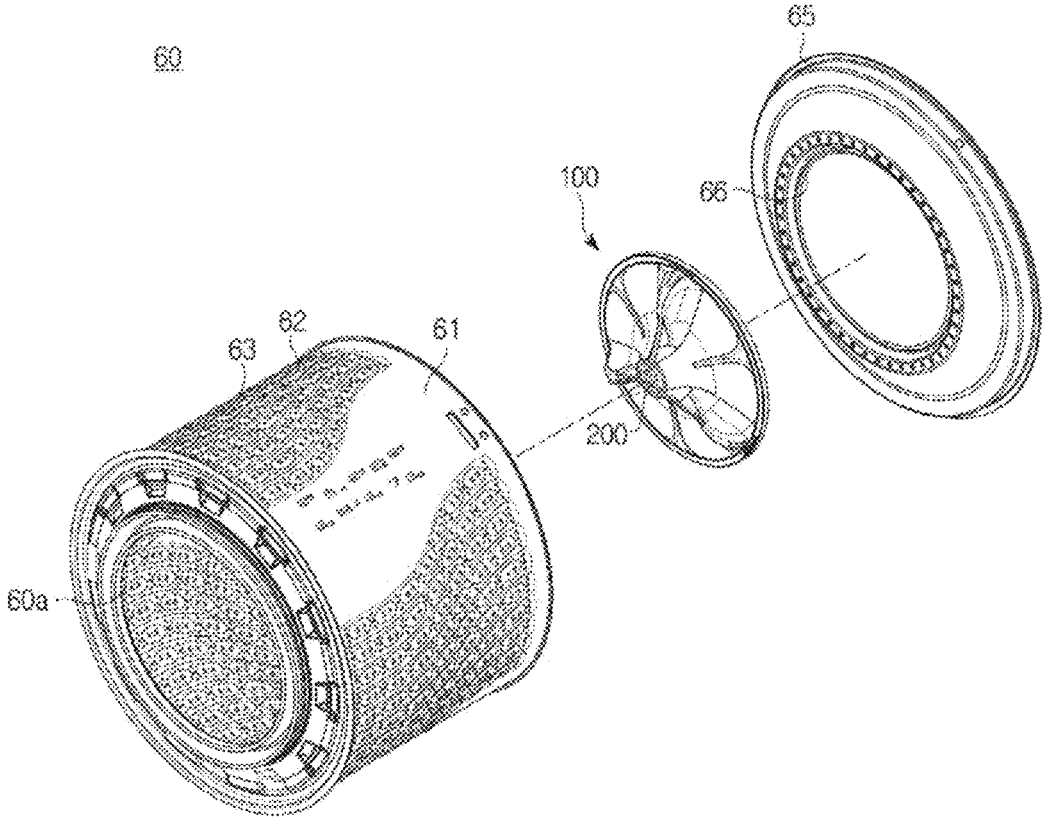
FIG. 3 is a partial exploded perspective view of a drum in which the pulsator according to an embodiment of the present disclosure is installed.

FIG. 1 is a perspective view of a washing machine according to an embodiment of the present disclosure, FIG. 2 is a cross-sectional view of the washing machine provided with a pulsator according to an embodiment of the present disclosure, and FIG. 3 is a partial exploded perspective view of a drum in which the pulsator according to an embodiment of the present disclosure is installed.

As illustrated in FIGS. 1 to 3, a washing machine 1 includes a cabinet 10, a tub 50 and a drum 60 disposed inside the cabinet 10 and accommodating washing water or rinsing water to be used for washing and rinsing, and a driving device 80 configured to rotate the tub 50 and the drum 60.

The cabinet 10 includes a control panel 20 including an input 21 to receive an operation command of the drum washing machine 1 from a user and a display 22 to display operation information.

The input 21 is configured to receive commands of a user related to washing, rinsing, dehydrating and drying operations such as washing time, rinsing time, dehydrating time, drying time, operation and temporary operation. The input 21 may include a push button or a rotary button.

The display 22 displays information related to the operation of the drum washing machine 1 such as the amount of washing water, a process in which the drum washing machine 1 is performing, and the time remaining until the washing is finished, and may include a liquid crystal display (LCD) panel and a light emitting diode (LED) panel.

An embodiment of the present disclosure illustrates that the input 21 and the display 22 are each provided as a rotary button and a liquid crystal display panel, but the present disclosure is not limited thereto. For example, the input and the display may be integrally provided as a touch screen panel (TSP).

The cabinet 10 includes frames 10*a*, 10*b*, 10*c*, 10*d*, and 10*e*. The frames 10*a*, 10*b*, 10*c*, 10*d*, and 10*e* include the upper frame 10*a* and the lower frame 10*e* forming an upper surface and a lower surface of the cabinet 10, the front frame 10*b* and the rear frame 10*c* forming a front surface and a rear surface, and the side frames 10*d* forming opposite side surfaces, respectively.

A first opening 11 is formed on the front frame 10*b* so that laundry may be put into the drum 60. The first opening 11 may be opened and closed by a door assembly 30 installed on the front frame 10*b*.

The door assembly 30 may be provided to correspond to the first opening 11 of the front frame 10*b*. The door assembly 30 includes a first door 31 having a circular shape corresponding to the first opening 11. The first door 31 includes a first door body 31*a* rotatably installed on the front frame 10*b* to open and close the first opening 11.

The door assembly 30 includes a second opening 31*b* formed on the first door body 31*a*. The second opening 31*b* may be opened and closed independently of the first opening 11. The door assembly 30 includes a second door 32 corresponding to the second opening 31*b*. The second door 32 is rotatably installed on the first door body 31*a* to open and close the second opening 31*b*. The second door 32 may be opened and closed independently of the first door 31, so that additional laundry or a detergent may be put by opening the second door 32 in a state in which the first door 31 is closed. That is, the second opening 31*b* is formed to be in communicate with the inside of the cabinet 10 and the inside of the drum 60.

A diaphragm 45 may connect the cabinet 10 and the tub 50. The diaphragm 45 may be disposed between the first opening 11 of the cabinet 10 and an opening 51 of the tub 50. The diaphragm 45 may reduce vibration transmitted to the front frame 10*b* side when the drum 60 rotates.

A water supply pipe 13 configured to supply washing water to the tub 50 is installed above the tub 50. A water supply valve 14 is installed on one side of the water supply pipe 13.

A detergent supply device 40 is connected to the tub 50 through a connection pipe 16. Water supplied through the water supply pipe 13 is supplied to the inside of the tub 50 together with the detergent via the detergent supply device 40.

The tub 50 is supported by a damper 17. The damper 17 connects an inner bottom of the cabinet 10 and an outer surface of the tub 50. The damper 17 may reduce vibration and impact generated by a vertical movement of the tub 50.

A drain pump 18 to discharge water in the tub 50 to the outside of the cabinet 10, a connection hose 18*a* connecting the tub 50 and the drain pump 18 so that water in the tub 50 may be introduced into the drain pump 18, and a drain hose 19 to guide water pumped by the drain pump 18 to the outside of the cabinet 10 are provided below the tub 50.

The drum 60 has a substantially cylindrical shape in which front and rear sides are open and may be disposed rotatably inside the tub 50. The drum 60 may include a drum opening 60*a* formed on the front side. A central axis of the drum 60 may be disposed parallel to a central axis of the tub 50.

The drum 60 may perform washing by lifting and falling laundry while rotating inside the tub 50. A plurality of through holes 62 may be formed on a circumferential surface of the drum 60 so that the washing water stored in the tub 50 passes through. At least one protrusion 63 protruding through the inside of the drum 60 may be provided on the circumferential surface of the drum 60. The at least one protrusion 63 may rub against laundry when the laundry is washed, thereby improving washing performance.

The drum 60 may include a cylinder part 61 and a rear cover 65.

The cylinder part 61 forms a side surface of the drum 60. The cylinder part 61 may include the plurality of through holes 62 and the at least one protrusion 63.

The rear cover 65 may be provided on one side of the cylinder part 61. The rear cover 65 may form a rear surface of the drum 60. The rear cover 65 may be disposed at the rear of the cylinder part 61 and configured to extend toward a rotation shaft. The rear cover 65 may be disposed along a circumference of a pulsator 100. A pulsator installation portion 66 for installing the pulsator 100 may be formed in a central portion of the rear cover 65.

The rear cover 65 is disposed to be spaced apart from a radius of rotation of the pulsator 100, so that interference between the pulsator 100 and the rear cover 65 can be prevented. The rear cover 65 may be configured to be seated on a flange shaft 70 supporting the drum 60. That is, the rear cover 65 may be coupled to the flange shaft 70.

The pulsator 100 is disposed inside the rear of the drum 60. The pulsator 100 may be configured to be rotatable with respect to the drum 60. The pulsator 100 may be configured to be rotatable independently of the drum 60. That is, the pulsator 100 may rotate in the same direction as the drum 60 or may rotate in a different direction from the drum 60. A rotation shaft of the pulsator 100 may be provided to be the same as the rotation shaft of the drum 60.

A driving device 80 configured to provide power may be provided at the rear of the rear cover 65. The driving device 80 may include a first driving device 81 providing power to the pulsator 100 and a second driving device 82 providing power to the drum 60.

The first driving device 81 may include a first driving motor 81*d* generating a rotational force for rotating the pulsator 100, a first shaft 81*a* extending rearward from the pulsator 100 and serving as the rotation shaft of the pulsator 100, a first pulley 81*b* connected to the first shaft 81*a*, and a first belt 81*c* connecting the first driving motor 81*d* and the first pulley 81*b*.

The first driving motor 81*d* may be fixed to an outer side of the tub 50 and may provide power to the pulsator 100. The first driving motor 81*d* includes a first motor shaft 81*e*, and the first motor shaft 81*e* is disposed at a position of extending further to the rear of the cabinet 10 than a second motor shaft 82*e*, so that the first belt 81*c* and a second belt 82*c* may be configured not to interfere with each other.

The first shaft 81*a* may be connected to a rear surface of the pulsator 100 and may extend from the pulsator 100 along the rotation shaft of the pulsator 100. The first shaft 81*a* may extend to the rear of the pulsator 100. The first shaft 81*a* may be the rotation shaft of the pulsator 100. An embodiment of the present disclosure illustrates that the first shaft 81*a* is formed separately from the pulsator 100 and is coupled thereto, but the present disclosure is not limited thereto. For example, the first shaft may be integrally formed with the pulsator.

A first bearing 81*f* configured to rotatably support the first shaft 81*a* may be provided on an outer circumferential surface of the first shaft 81*a*. The first bearing 81*f* may be fixed by the second shaft 82*a*. One end of the first shaft 81*a* may be connected to the pulsator 100, and the other end of the first shaft 81*a* may be connected to the first pulley 81*b*. The first shaft 81*a* may rotate the pulsator 100 by transmitting the power, which is transmitted from the first driving motor 81*d* to the first pulley 81*b*, to the pulsator 100.

The second driving device 82 may include a second driving motor 82*d* generating a rotational force for rotating the drum 60, a second shaft 82*a* extending rearward from the drum 60 and serving as the rotation shaft of the drum 60, a second pulley 82*b* connected to the second shaft 82*a*, and a second belt 82*c* connecting the second pulley 82*b* and the second driving motor 82*d*.

The second driving motor 82*d* may be fixed to an outer side of the tub 50. The second driving motor 82*d* may provide power to the drum 60. The second driving motor 82*d* may be mounted on a portion different from a portion of a lower end portion of the outer circumferential surface of the tub 50 to which the first driving motor 81*d* is fixed.

The second driving motor 82*d* includes a second motor shaft 82*e*, and the second motor shaft 82*e* is disposed at a position of extending less to the rear of the cabinet 10 than the first driving motor 81*d*, so that interference between the second belt 82*c* and the first belt 81*c* may be prevented.

The first driving motor 81*d* and the second driving motor 82*d* may be motors capable of forward rotation and reverse rotation. The first driving motor 81*d* and the second driving motor 82*d* may include BLDC motors.

The second shaft 82*a* may be connected to the rear surface of the drum 60 and may extend from the drum 60 along the rotation shaft of the drum 60. The second shaft 82*a* may extend to the rear of the pulsator 100. The second shaft 82*a* may be the rotation shaft of the drum 60. The second shaft 82*a* may pass through the rear cover 65 of the drum 60 to connect the drum 60 and the second pulley 82*b*. An embodiment of the present disclosure illustrates that the second shaft 82*a* is formed separately from the drum 60 and is coupled to the drum 60, but the present disclosure is not limited thereto. For example, the second shaft may be integrally formed with the drum.

The second shaft 82*a* may be coupled to the flange shaft 70 provided on the rear surface of the drum 60. The flange shaft 70 is coupled to one side of the drum 60. The flange shaft 70 may rotate together with the rotation of the second shaft 82*a*. The drum 60 may rotate by the flange shaft 70 transmitting a rotational force of the second shaft 82*a* to the drum 60.

A second bearing 82*f* configured to rotatably support the second shaft 82*a* may be provided on an outer circumferential surface of the second shaft 82*a*. The second bearing 82*f* may be fixed to the tub 50. One end of the second shaft 82*a* may be connected to the drum 60, and the other end of the second shaft 82*a* may be connected to the second pulley 82*b*. The second shaft 82*a* may rotate the drum 60 by transmitting the power, which is transmitted from the second driving motor 82*d* to the second pulley 82*b*, to the drum 60.

The second shaft 82*a* may have a hollow inside so that the first shaft 81*a* may be rotatably inserted.

Figure 4:
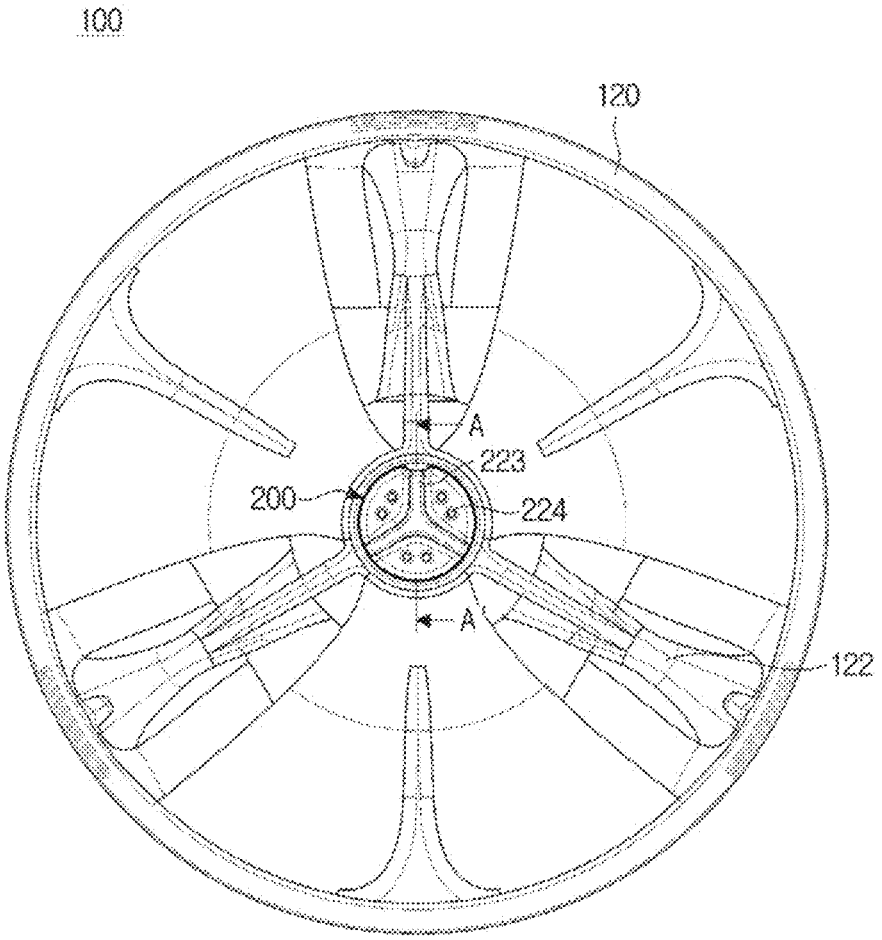
FIG. 4 is a front view of the pulsator according to an embodiment of the present disclosure.
Figure 5:
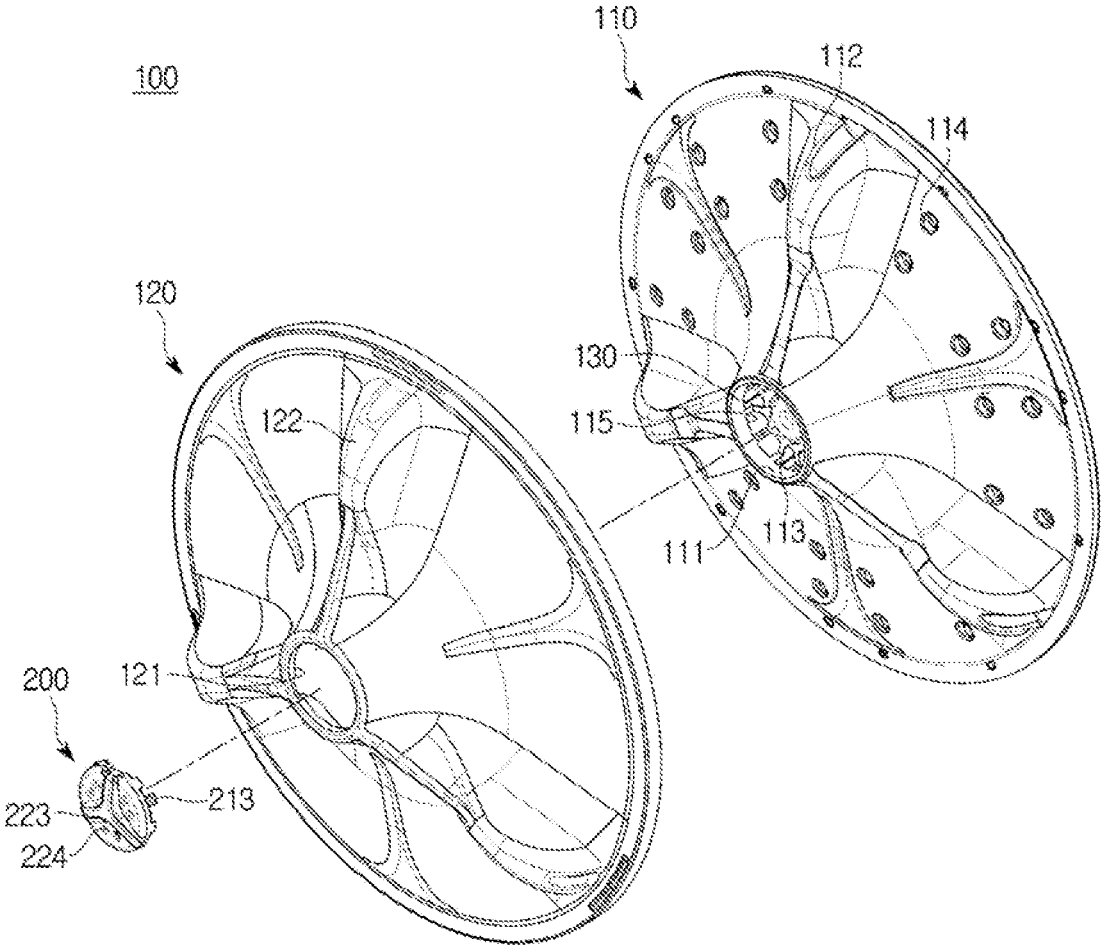
FIG. 5 is an exploded perspective view of the pulsator according to an embodiment of the present disclosure.
Figure 6:
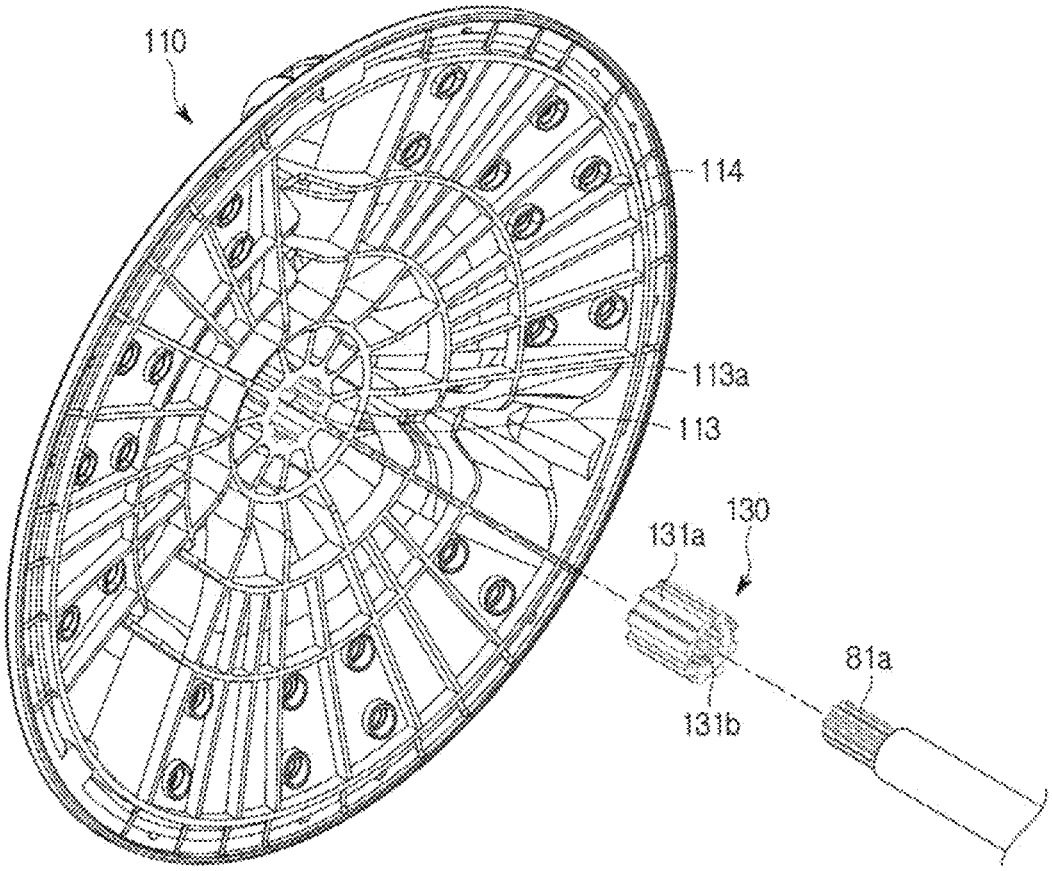
FIG. 6 is an exploded perspective view illustrating a combination of the pulsator and a driving portion according to an embodiment of the present disclosure.
Figure 7:
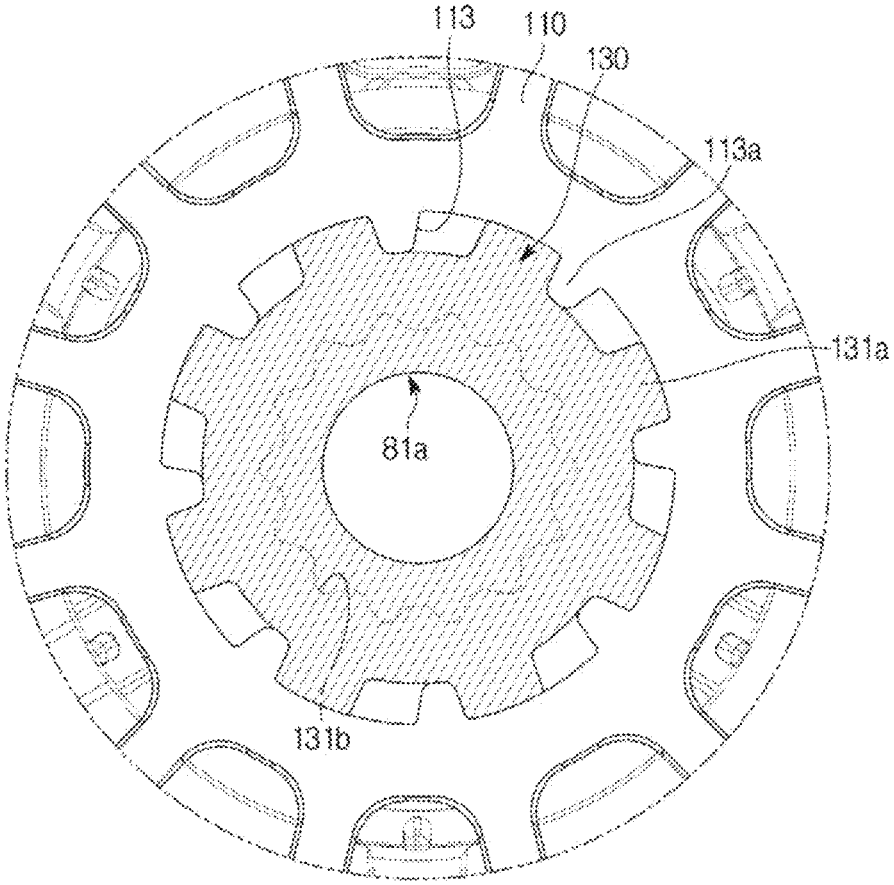
FIG. 7 is a cross-sectional view illustrating a combination of the pulsator and the driving portion according to an embodiment of the present disclosure.
Figure 8:
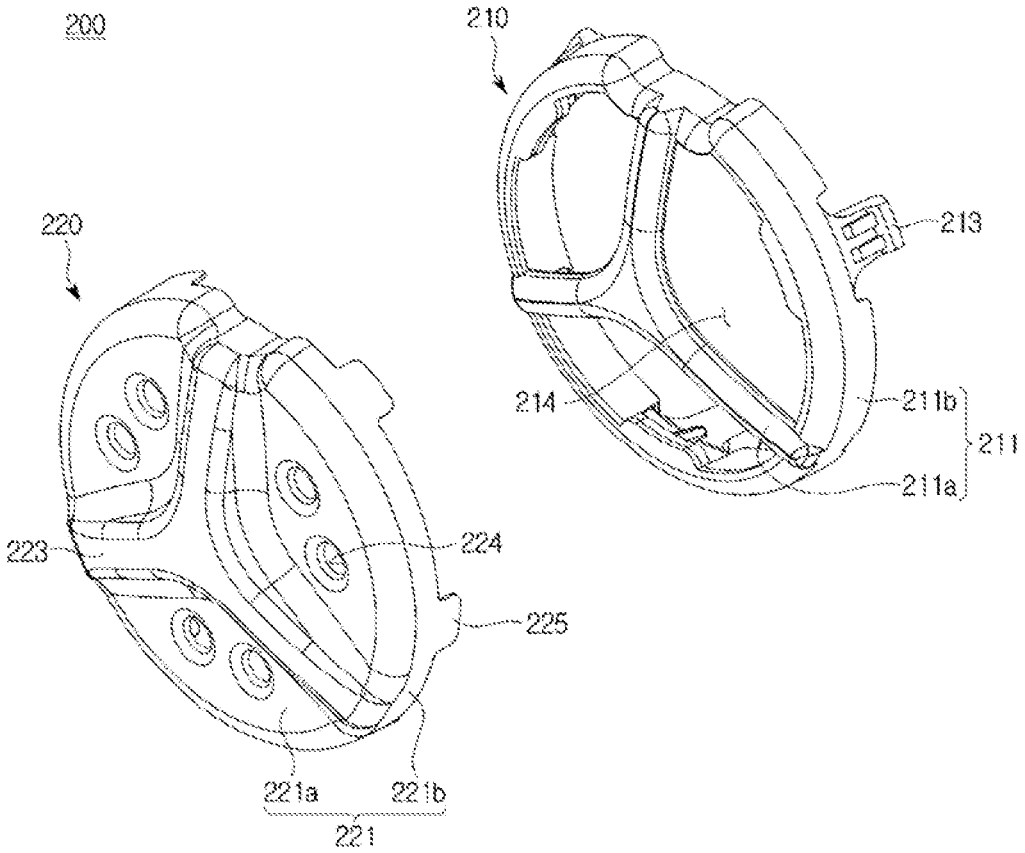
FIG. 8 is an exploded perspective view of a cap of the pulsator according to an embodiment of the present disclosure.
Figure 9:
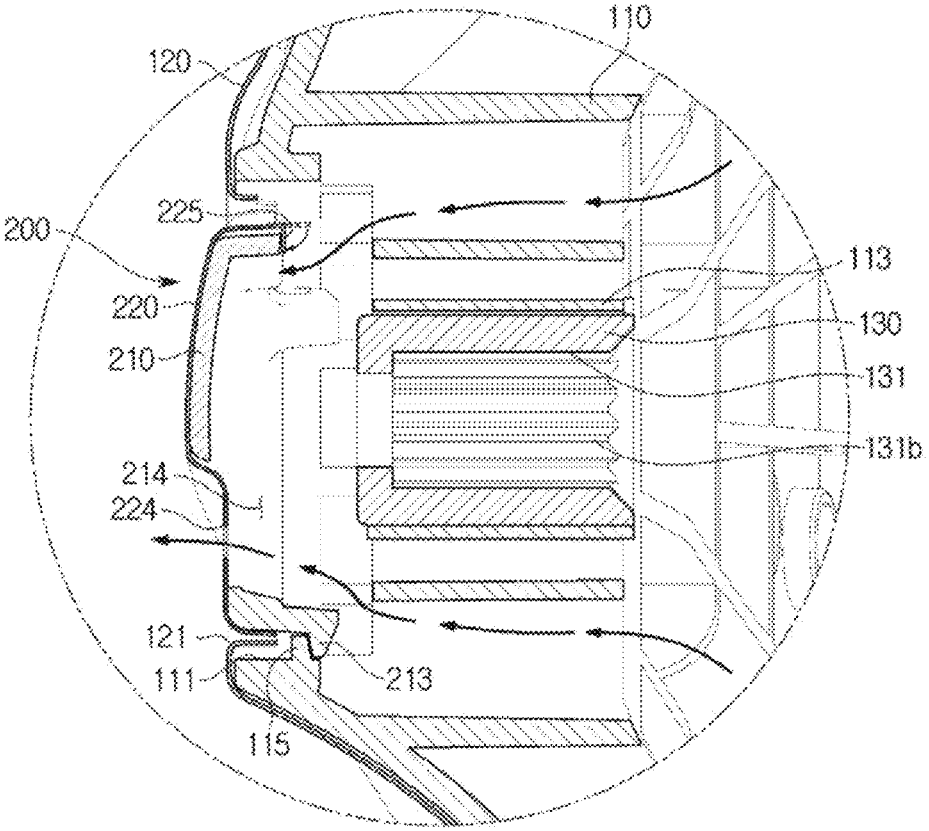
FIG. 9 is a cross-sectional view taken along line A-A' of FIG. 4, illustrating an air flow for cooling the pulsator according to an embodiment of the present disclosure.

FIG. 4 is a front view of the pulsator according to an embodiment of the present disclosure, FIG. 5 is an exploded perspective view of the pulsator according to an embodiment of the present disclosure, FIG. 6 is an exploded perspective view illustrating a combination of the pulsator and a driving portion according to an embodiment of the present disclosure, FIG. 7 is a cross-sectional view illustrating a combination of the pulsator and the driving portion according to an embodiment of the present disclosure, FIG. 8 is an exploded perspective view of a cap of the pulsator according to an embodiment of the present disclosure, and FIG. 9 is a cross-sectional view taken along line A-A' of FIG. 4, illustrating an air flow for cooling the pulsator according to an embodiment of the present disclosure.

As illustrated in FIGS. 4 to 9, the pulsator 100 includes a pulsator body 110 and a pulsator cover 120 provided at the front of the pulsator body 110.

The pulsator body 110 may include at least one pulsator body blade 112 protruding forward. The pulsator body 110 may be formed in a substantially circular shape. The pulsator body blade 112 is formed to protrude forward of the pulsator body 110. A plurality of the pulsator body blades 112 may be provided. An embodiment of the present disclosure illustrates that three of the pulsator body blades 112 are arranged at a predetermined interval (120 degrees), but the present disclosure is not limited thereto. The shape and number of blades may be variously changed. The pulsator body blade 112 is configured to generate water flow in the front and rear directions in the drum 60 during washing.

A plurality of air holes 114 may be formed in the pulsator body 110. The plurality of air holes 114 of the pulsator body 110 may be disposed at a position of being spaced apart from the pulsator body blade 112.

A through hole 111 for coupling the first shaft 81*a* provided to rotate the pulsator 100 is formed at the center of the pulsator body 110. The through hole 111 is formed at the center of the pulsator body 110. The first shaft 81*a* and the pulsator body 110 may be connected through a connection member 130. The pulsator body 110 is provided with a connection member installation portion 113 to couple the connection member 130. The connection member installation portion 113 may be provided at the center of the pulsator body 110.

The connection member 130 is formed in a cylindrical shape. The connection member 130 is provided to connect the pulsator body 110 and the first shaft 81*a*. A first coupling protrusion 131*a* to be coupled to the pulsator body 110 and a second coupling protrusion 131*b* to be coupled to the first shaft 81*a* may be formed on an inner circumferential surface and an outer circumferential surface of the connection member 130, respectively. The first coupling protrusion 131*a* and the second coupling protrusion 131*b* may have different shapes and thicknesses.

The connection member 130 is configured such that an outer side thereof is connected to the pulsator body 110 and an inner side thereof is connected to the first shaft 81*a*. The outer circumferential surface of the connection member 130 is formed in a shape corresponding to the connection member installation portion 113 of the pulsator body 110. The first coupling protrusion 131*a* may be formed on the outer circumferential surface of the connection member 130. The inner side of the connection member 130 is formed in a shape corresponding to the first shaft 81*a* to be connected to the first shaft 81*a*. The second coupling protrusion 131*b* may be formed on the inner circumferential surface of the connection member 130.

A first coupling groove 113*a* having a shape corresponding to the first coupling protrusion 131*a* of the connection member 130 may be formed on the connection member installation portion 113 of the pulsator body 110.

Power of the first shaft 81*a* is transmitted to the pulsator body 110 by the first coupling protrusion 131*a* and the second coupling protrusion 131*b* of the connection member 130, so that the pulsator 100 may be rotated.

The pulsator cover 120 may be provided at the front of the pulsator body 110. The pulsator cover 120 may be formed of a metal material. The pulsator body 110 may be injection molded. The pulsator body 110 and the pulsator cover 120 may be formed of different materials. The metallic pulsator cover 120 may cover the pulsator body 110 in front of the injection-molded pulsator body 110 to prevent temperature rise caused by friction with laundry. The aesthetics may be improved by the pulsator cover 120 made of metal.

Air introduced through the plurality of air holes 114 formed on the pulsator body 110 may be delivered to the pulsator cover 120 to prevent temperature rise caused by friction between the pulsator 100 and laundry.

The pulsator cover 120 may be formed in a shape corresponding to the pulsator body 110. The pulsator cover 120 may include at least one pulsator cover blade 122 protruding forward. The pulsator cover 120 may be formed in a substantially circular shape. The pulsator cover blade 122 is coupled to the pulsator body blade 112 and is configured to generate water flow in the front and rear directions in the drum 60 during washing.

A cap installation hole 121 for coupling a cap 200 is formed at the center of the pulsator cover 120. The cap installation hole 121 may be formed at a position corresponding to the through hole 111. The cap installation hole 121 is formed at the center of the pulsator cover 120.

The pulsator 100 may include the cap 200. The cap 200 is provided to cover at least a portion of a front surface of the pulsator 100. The cap 200 may be installed in the cap installation hole 121 of the pulsator cover 120.

The cap 200 may include a first cap 210 rotatably coupled to the pulsator 100 and a second cap 220 provided at the front of the first cap 210 to cover the first cap 210.

The first cap 210 and the second cap 220 may be formed of different materials. The first cap 210 may be injection molded. The second cap 220 may be made of a metal material.

The first cap 210 is formed as a circular first cap body 211. The first cap body 211 may include a first cap front surface 211*a* and a first cap side surface 211*b* protruding to the rear of the first cap front surface 211*a*.

The first cap body 211 includes a coupling part 213 protruding rearward. The coupling part 213 may be provided on the first cap side surface 211*b* of the first cap body 211. The coupling part 213 may be formed to protrude to the rear of the first cap side 211*b*. The coupling part 213 is formed in a hook shape. The coupling part 213 is provided to correspond to the cap coupling part 213 of the pulsator body 110. A plurality of the coupling parts 213 may be provided. An embodiment of the present disclosure illustrates that the coupling part is formed in a hook shape, but the coupling part may include various configurations for assembling the first cap to the pulsator.

A plurality of holes (hereinafter, referred to as first holes) may be formed on the first cap body 211. A first hole 214 may be formed on at least a portion of the first cap front surface 211*a* of the first cap body 211. A plurality of the first holes 214 may be formed. An embodiment of the present disclosure illustrates that the first holes 214 are formed in a fan shape in three directions of the first cap front surface 211*a* of the first cap body 211, but the present disclosure is not limited thereto. The shape and number of the first holes may be variously changed.

Air introduced through the first hole 214 of the first cap 210 may cool the pulsator 100 while circulating and may prevent temperature rise caused by friction between the pulsator 100 and laundry.

The second cap 220 is provided at the front of the first cap 210 to cover the first cap 210. The second cap 220 may be formed in a shape corresponding to the first cap 210. The second cap 220 may be formed of a metal material.

The second cap 220 is configured to surround the first cap body 211 from the outside of the first cap body 211. The second cap 220 is formed as a circular second cap body 221. The second cap body 221 may include a second cap front surface 221*a* and a second cap side surface 221*b* protruding to the rear of the second cap front surface 221*a*.

The second cap side surface 221*b* may include a fixing part 225 protruding. The fixing part 225 is provided to protrude from the second cap side surface 221*b*. The fixing part 225 is provided to couple the second cap 220 and the first cap 210. The fixing part 225 which is a plate-shaped protrusion may be coupled to the first cap side surface 211*b* of the second cap 220. The fixing part 225 may be bent and fixed to the first cap side surface 211*b*. An embodiment of the present disclosure illustrates that the fixing part which is a plate-shaped protrusion is bent and fixed to the first cap, but the present disclosure is not limited thereto. For example, the fixing part may include a configuration capable of fixing the first cap and the second cap.

The second cap front surface 221*a* may be provided with at least one cap blade 223 protruding forward. The cap blade 223 is formed to protrude forward from the second cap front surface 221*a*. The cap blade 223 is formed radially outward from the center of the second cap front surface 221*a*. An embodiment of the present disclosure illustrates that three of the cap blades are arranged to be spaced apart from each other at a predetermined interval, but the present disclosure is not limited thereto.

During washing, the pulsator 100 and the cap 200 rotate together, and at this time, the cap blade 223 formed on the cap 200 may generate water flow in the front and rear directions inside the drum 60. The cap blade 223 may reinforce the strength of the second cap 220. The cap blade 223 is provided to enhance an aesthetic effect.

The second cap 220 of a metal material is provided to reinforce the strength of the first cap 210 in the front of the injection-molded first cap 210 and prevent temperature rise caused by friction with laundry. A plurality of holes (hereinafter, second holes 224) is formed on the second cap front surface 221*a* of the second cap body 211. One or more of the second holes 224 are provided. The second hole 224 is formed on the second cap front surface 221*a*. The second hole 224 may be formed at a position corresponding to the first hole 214. An embodiment of the present disclosure illustrates that two of the second holes 224 are formed between the respective cap blades 223 of the second cap body 211, but the present disclosure is not limited thereto. The shape and number of the second holes may be variously changed.

Air introduced through the first hole 214 of the first cap 210 may circulate through the second hole 224 of the second cap 220. Air introduced through the first hole 214 of the first cap 210 may cool the pulsator 100 while circulating and may prevent temperature rise caused by friction between the pulsator 100 and laundry.

The first cap 210 and the second cap 220 rotate integrally. During dehydration, the cap 200 is stopped together with the pulsator 100 or rotates at a low speed. During dehydration, the drum 60 rotates at a high speed, and the pulsator 100 and the cap 200 are stopped or rotate at a low speed. For example, during dehydration, the drum 60 may rotate at a high speed of 1600 to 1400 rpm, and the pulsator 100 may rotate at a low speed of 50 rpm. Laundry may rub against the pulsator 100 and the cap 200 to generate heat due to friction, thereby increasing a temperature thereof. At this time, air is circulated toward the pulsator 100 through the plurality of air holes 114 formed on the pulsator 100 and the plurality of holes 214 and 224 formed on the cap 200, so that temperature rise of the pulsator 100 and the cap 200 may be prevented.

While the present disclosure has been particularly described with reference to exemplary embodiments, it should be understood by those of skilled in the art that various changes in form and details may be made without departing from the spirit and scope of the present disclosure.

The invention claimed is:

1. A washing machine comprising:

a cabinet in which an opening for putting laundry is formed on a front side;

a tub provided inside the cabinet;

a drum rotatably provided inside the tub;

a pulsator rotatably installed on the drum; and a cap coupled to the pulsator to cover at least a portion of a front surface of the pulsator, wherein the cap includes:

a first cap formed of an injection-molded material; and a second cap formed of a metal material, and coupled to the first cap, the second cap surrounding the first cap while in contact with an outer side of the first cap, a front surface of the first cap is surrounded by a rear surface of the second cap while making a full-contact with the rear surface of the second cap, and each of the first cap and the second cap includes a plurality of holes.

2. The washing machine according to claim 1, wherein the first cap and the second cap comprises the plurality of holes formed to discharge air, respectively.

3. The washing machine according to claim 1, wherein the first cap and the second cap are formed of different materials.

4. The washing machine according to claim 1, wherein the first cap includes a plurality of first holes, the second cap includes a plurality of second holes, and each of the plurality of first holes has a size larger than each of the plurality of second holes.

5. The washing machine according to claim 1, wherein some of the plurality of holes formed in the first cap communicate with the plurality of holes formed in the second cap.

6. The washing machine according to claim 1, wherein air flows through the plurality of holes by the rotation of the pulsator or the drum.

7. The washing machine according to claim 1, wherein the second cap comprises a cap blade protruding forward.

8. The washing machine according to claim 1, further comprising a plurality of motors respectively connected to the pulsator and the drum, and configured to independently rotate the pulsator and the drum.

9. The washing machine according to claim 8, wherein the plurality of motors respectively comprises a first shaft configured to rotate the pulsator and a second shaft configured to rotate the drum.

10. The washing machine according to claim 9, wherein:

the pulsator comprises a pulsator body on which a through hole to which the first shaft is connected is formed, and a pulsator cover configured to cover a front surface of the pulsator body and comprising a cap installation portion corresponding to the through hole; and the first cap and the second cap are installed in the cap installation portion.

11. The washing machine according to claim 10, wherein:

the pulsator body and the pulsator cover are formed of different materials; and the pulsator cover comprises a metal material.

12. The washing machine according to claim 11, wherein the pulsator body comprises a plurality of air holes.

* * * * *